US008354930B1

(12) United States Patent
Daniel

(10) Patent No.: US 8,354,930 B1
(45) Date of Patent: Jan. 15, 2013

(54) LOCATOR AND CUSTOMER SERVICE APPARATUS AND METHOD

(75) Inventor: Isaac Sayo Daniel, Miami, FL (US)

(73) Assignee: F3M3 Companies, Inc., Miramar, FL (US)

( * ) Notice: Subject to any disclaimer, the term of this patent is extended or adjusted under 35 U.S.C. 154(b) by 514 days.

(21) Appl. No.: 12/626,817

(22) Filed: Nov. 27, 2009

(51) Int. Cl.
*G08B 3/10* (2006.01)
*G08B 13/14* (2006.01)

(52) U.S. Cl. ..... 340/568.1; 340/539.13; 340/572.1

(58) Field of Classification Search ..... 340/426.1, 340/426.19, 539.13, 568.1, 572.1
See application file for complete search history.

(56) References Cited

U.S. PATENT DOCUMENTS 4,736,195 A * 4/1988 McMurtry et al. ..... 340/568.3
5,939,975 A * 8/1999 Tsuria et al. ..... 340/426.18
5,966,093 A * 10/1999 Chapman ..... 342/357.52
6,150,923 A * 11/2000 Johnson et al. ..... 340/384.6
7,265,666 B2 * 9/2007 Daniel ..... 340/539.11
7,714,709 B1 * 5/2010 Daniel ..... 340/539.11
2002/0013771 A1 * 1/2002 Blackson et al. ..... 705/43
2003/0034915 A1 * 2/2003 Sasaki et al. ..... 342/357.07
2004/0107028 A1 * 6/2004 Catalano ..... 701/2
2007/0176771 A1 * 8/2007 Doyle ..... 340/539.13
2007/0200664 A1 * 8/2007 Proska et al. ..... 340/5.42
2008/0186162 A1 * 8/2008 Rajan et al. ..... 340/539.13
2009/0040102 A1 * 2/2009 Medina Herrero et al. ..... 342/357.07
2010/0176950 A1 * 7/2010 Bartholf et al. ..... 340/572.7
2012/0059582 A1 * 3/2012 Daniel ..... 701/483

* cited by examiner

*Primary Examiner* — Jennifer Mehmood
*Assistant Examiner* — Andrew Bee
(74) *Attorney, Agent, or Firm* — Alberto Interian, III, Esq.

(57) ABSTRACT

An apparatus comprising: at least one processor, at least one storage means connected to the processor and at least one locator unit connected to the processor. An apparatus comprising: a case and at least one locator unit connected to the case. A method comprising: using at least one processor connected to a device to perform any of the following: determining the device's location, and communicating the location to a central station.

30 Claims, 6 Drawing Sheets

LOCATOR AND CUSTOMER SERVICE APPARATUS AND METHOD

FIELD

The present disclosure relates generally to electronic systems, and more particularly, to systems, methods, and various other disclosures related to location tracking and customer service.

BACKGROUND

It is common practice for service companies to loan or lease their property to consumers. Some examples include cable and satellite television service providers, internet service providers, telephone service providers, and the like. In the case of cable and satellite television service providers, the provider loans and/or leases its customers satellite/cable television boxes, through which the television signal can be received. In the case of satellite television providers, companies also loan satellite dish hardware to their customers.

A problem for such companies is theft and or misuse of their property by their customers. In some cases, customers remove a company's property without permission, and use it in another location, thus breaking their service contract. In other cases, customers simply steal the company's property altogether. Thus far, companies have not had a way of tracking their property to find out whether it has been removed or stolen.

Another issue companies face is how to improve customer service. Traditionally, if a customer needs customer service, they must call the company. The customer is then put on hold or run through a series of automated answering machines which try to gather information about the customer's problem. Current customer service programs, including customer service provided by cable and satellite television providers, can be quite frustrating to use for customers and inefficient for companies.

SUMMARY

The systems and methods described herein result from the realization that companies can track their loaned and/or leased property by providing a locator unit along with their property.

The systems and methods described herein result from the further realization that customer service can be improved by providing a communications means along with a company's loaned and/or leased property.

The systems and methods described herein result from the further realization that companies can improve their customer service related to loaned/leased property and track the property by providing a locator unit and a communications means along with the loaned/leased property.

Accordingly, the various embodiments and disclosures described herein solve the limitations of the prior art in a new and novel manner.

DETAILED DESCRIPTION OF PREFERRED EMBODIMENTS

Apparatuses

Figure 1:
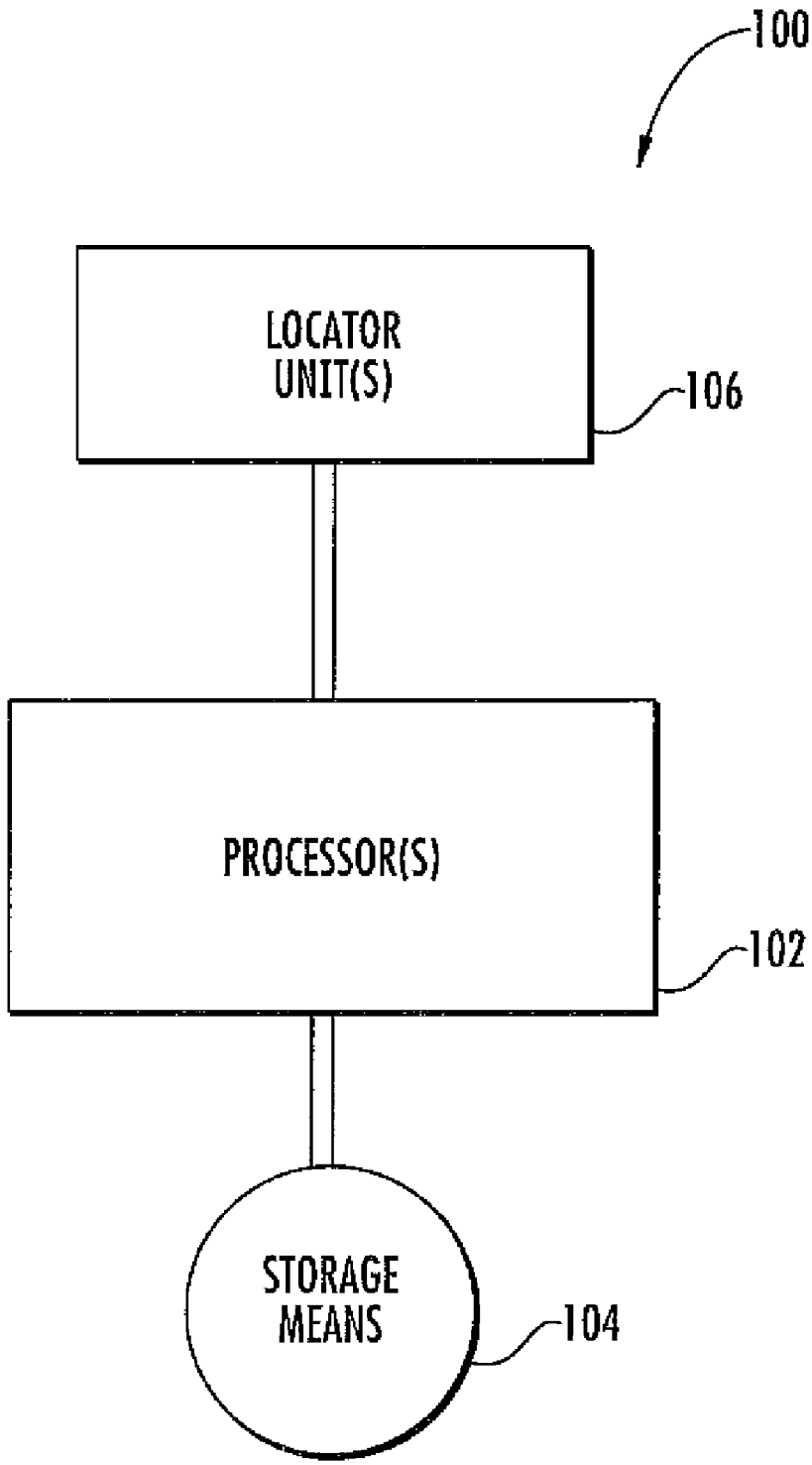
FIG. 1 shows an apparatus in accordance with one embodiment.

FIG. 1 shows an apparatus 100 in accordance with one embodiment. Apparatus 100 may comprise at least one processor 102, at least one storage means 104 connected to processor 102, and at least one locator unit 106 connected to processor 102. In one embodiment, storage means 104 and locator unit 106 may be connected to processor 102 via a circuit board (not shown). In some embodiments, the aforementioned connections may be electronic connections and/or mechanical connections. In the case of electronic connections, the electronic connections may be wired and/or wireless connections.

Processor 102 may be any type of processor, such as, but not limited to, a central processing unit (CPU), a microprocessor, a video processor, a front end processor, a coprocessor, a single-core processor, a multi-core processor, and the like. Processor 102 may be used to determine the location of apparatus 100 by calculating the location of apparatus 100, such as by triangulating the location of apparatus 100 based on at least one positioning system signal received by locator unit 110. In another embodiment, processor 102 may be wirelessly connected to locator unit 106 so that the location determination may be performed remotely.

In some embodiments, storage means 104 may be a storage device and may include memory, such as, but is not limited to, read-only memory, such as CD-ROMs, DVDs, floppy disks, and the like, read and write memory, such as a hard drive, floppy disc, CD-RW, DVD-RW, solid state memory, such as solid state hard drives, flash memory, and the like, and random access memory. Storage means 104 may be used to store information, such as apparatus information, including, but not limited to, model, user, lessee, lessor, contract expiration, previous reported and/or recorded locations, previous customer service information, such as, but not limited to, previous customer service issues, resolutions, and unresolved issues, payment information, such as, but not limited to, remaining balance, payment due date, payment amount, and the like, and media, such as, but not limited to, movie trailers and related advertising, news, weather, sports news, movies, television shows and advertising therefor, and the like. The information may be retrieved from storage means 104 using processor 102.

In some embodiments, locator unit 106 may comprise a communications means. The communications means may be a wireless communications means, such as, but not limited to, a radio frequency transceiver, a radio frequency receiver, and/or a radio frequency transmitter, including, but not limited to, a Bluetooth module. In embodiments where the wireless communications means is a radio frequency receiver, the radio frequency receiver may be any type of radio frequency receiver, including, but not limited to, a positioning system receiver, such as a global positioning system receiver and a local positioning system receiver, such as a Wi-Fi positioning system receiver. In other embodiments, the communications means may be a wireless modem, such as, but not limited to, a global system for mobile communications (GSM) modern.

Figure 2:
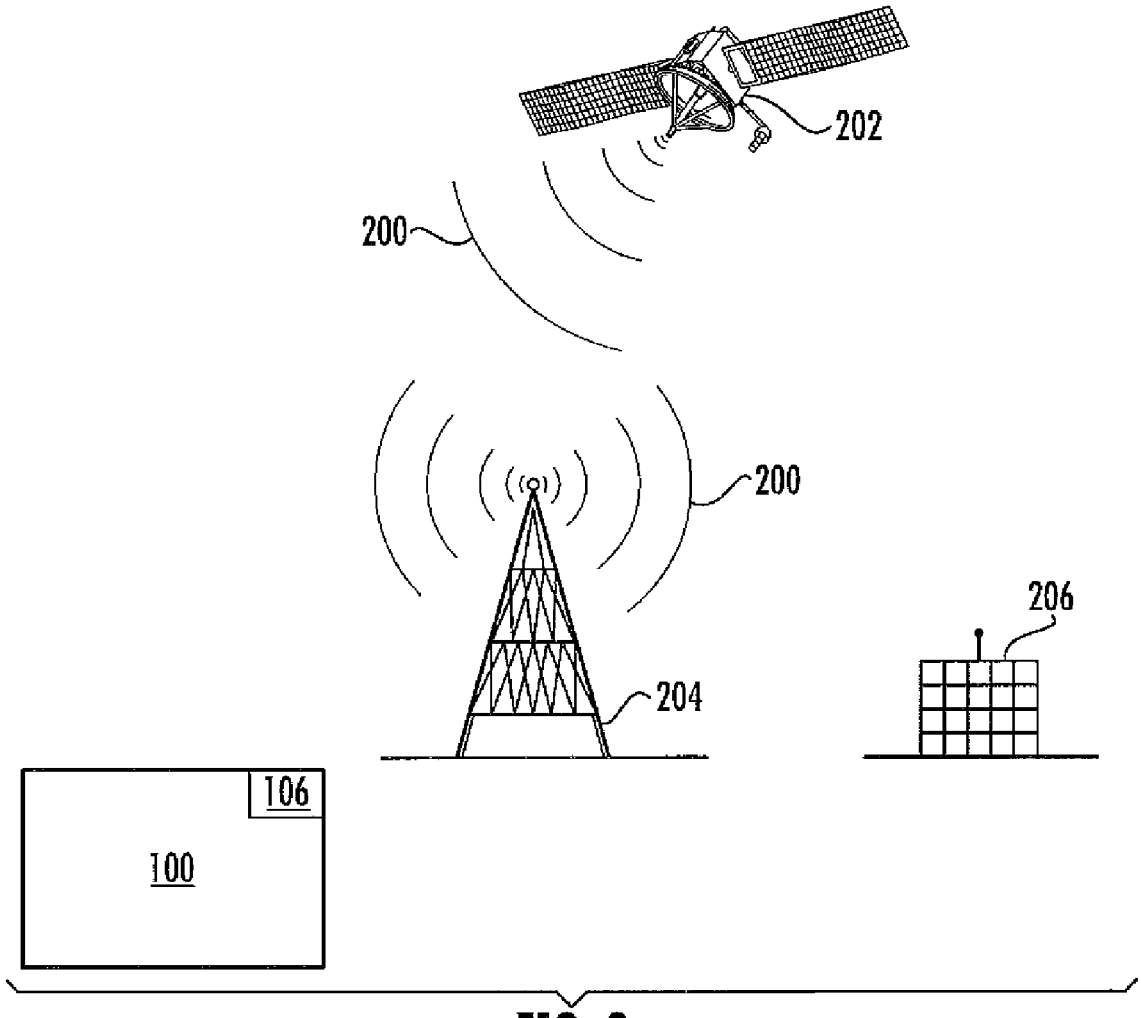
FIG. 2 shows an apparatus in accordance with various embodiments.

Referring to FIG. 2, in some embodiments, locator unit 106 may receive a signal 200, such as a location determination signal, from a positioning system, such as a global positioning system (GPS, or local positioning system, such as a Wi-Fi positioning system, which may originate from a satellite 202, or a ground based antenna 204.

Referring back to FIG. 1, in another embodiment, locator unit 106 may comprise a radio frequency identification tag (RFID tag). Such a tag may be used by a positioning system, such as any of the embodiments described directly above and elsewhere throughout the present disclosure, to determine the location of the locator unit 106. The RFID tag may be any kind of RFID tag, such as, but not limited to, an active RFID tag and/or a passive RFID tag.

In some embodiments, apparatus 100 may comprise a means for receiving a power supply, such as a battery, or external power source. The means for receiving a power supply may be a power terminal, a socket, a wire, a port, a contact, or the like. The means for receiving a power supply may be used to power apparatus 100, as well as any other devices connected to apparatus 100.

In yet another embodiment, apparatus 100 may comprise an activation switch electronically connected to locator unit 106. The activation switch may be any kind of switch, such as an electronic switch. In some embodiments, the activation switch may be activated by a radio signal, which may include a radio frequency beam. In other embodiments, the activation switch may be activated if and/or when apparatus 100 is disconnected from an external power source. In some embodiments, the activation switch may operate to activate locator unit 106, so as to preserve the power supply level while the locator unit is inactive, should the locator unit 106 be battery powered. In some embodiments, by activating locator unit 106 when apparatus 100 is disconnected from an external power source, a monitoring station would be notified if apparatus 100 is disconnected, and possibly being moved, as well as of the whereabouts of the apparatus 100's location.

Figure 3A:
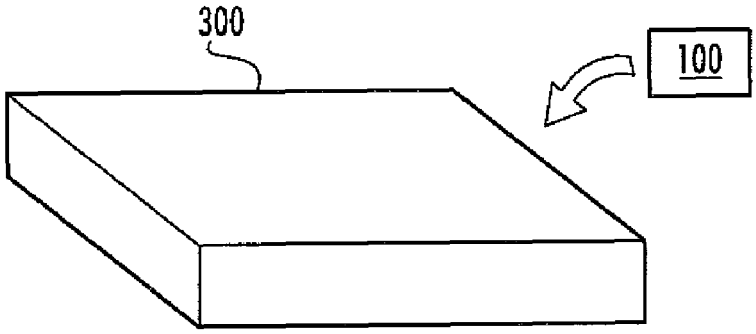
FIGS. 3A, 3B, and 3C show an apparatus in accordance with various embodiments.
Figure 3B:
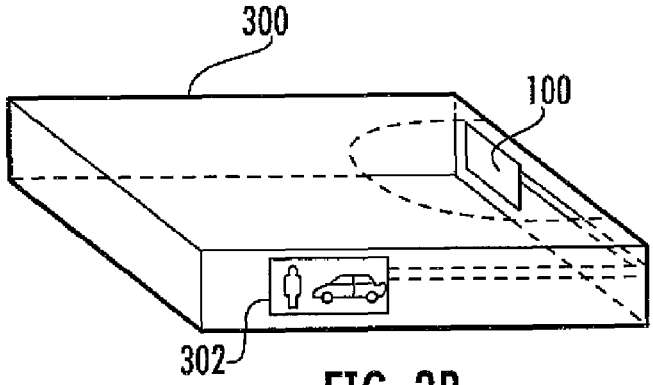
Figure 3C:
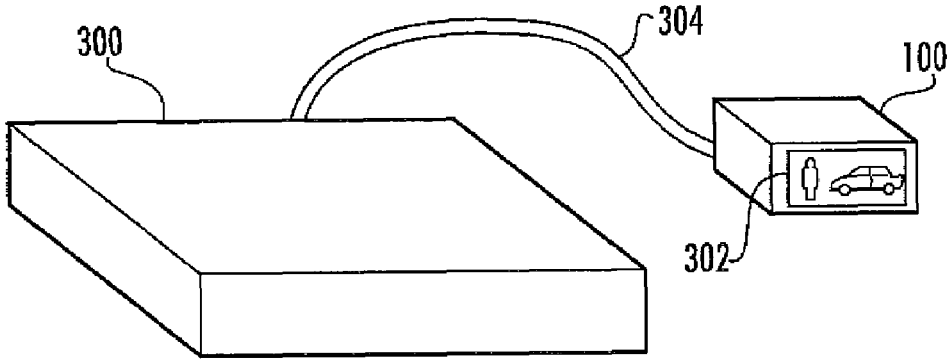

In a further embodiment, apparatus 100 may comprise a display means (as shown by numeral 302 in FIGS. 3B and 3C). Display means 302 may be any kind of display means, such as, but not limited to, an LCD screen, a monitor, an LED screen, and the like.

With reference to FIGS. 1 and 2, in yet another embodiment, apparatus 100 further comprises computer executable instructions readable by the processor and operative to determine when apparatus 100 has been disconnected from an external power source, switch apparatus 100's power source to an internal power source, such as a battery, activate locator unit 106, receive location determination signals 200 from a location positioning system, such as a GPS system, calculate the location of apparatus 100, such as by triangulating the location of apparatus 100 based on at least one positioning system signal received by locator unit 106 described above, and transmit apparatus 100's location to a central station 206. The computer executable instructions may be any type of computer executable instructions, which may be in the form of a computer program, the program being composed in any suitable programming language or source code, such as C++, C, JAVA, JavaScript, HTML, XML, and other programming languages. Central station 206 may be any kind of central station, such as but not limited to a monitoring station, a customer service center, a company office, a remote station, an observation station, and the like.

In one embodiment, the computer executable instructions are operative to use locator unit 106, which may include using the communications means, to receive location determination signals from a location positioning system, such as a global positioning system (GPS), or local positioning system, such as a Wi-Fi positioning system. In another embodiment, computer executable instructions are operative to use the communications means to transmit the apparatus's location to central station 206.

In yet another embodiment, the computer executable instructions may be operative to use the communications means to communicate with a wireless device. In some embodiments, the wireless device may be any type of wireless device, such as, but not limited to a remote control, wherein the communications means may include an infrared transceiver, a cellular phone, a personal digital assistant (PDA), a personal computer, and the like. In a further embodiment, the computer executable instructions may be operative to solicit at least one customer service request and/or message from the wireless device. The computer executable instructions may be operative to then transmit that customer service request and/or message to a central station, such as central station 206. The computer executable instructions may be operative to then receive a customer service response from a central station, such as central station 206.

In yet another embodiment, the computer executable instructions are operative to display at least one image on a display means (as shown by numeral 302 in FIGS. 3B and 3C). In some embodiments, the image may be a device's information, such as model number, user information such as lessee, lessor, contract expiration, previous reported and/or recorded locations, previous customer service information, such as, but not limited to, previous customer service issues, resolutions, and unresolved issues, payment information, such as, but not limited to, remaining balance, payment due date, payment amount, and the like, and media, such as, but not limited to, movie trailers and related advertising, general advertising, news, weather, sports news, movies, television shows and advertising therefor, and the like.

Referring now to FIGS. 3A, 3B, and 3C, in some embodiments, apparatus 100 may be connected to a device 300, such as but not limited to, electronic device. Apparatus 100 may be electronically and/or mechanically connected to device 300. In some embodiments, apparatus 100 is positioned within device 300, as shown in FIG. 3B, while in other embodiments, apparatus 100 is positioned on or near a surface of device 300. In yet another embodiment, apparatus 100 may be positioned outside device 300, as shown in FIG. 3C, and may be electronically and/or mechanically to device 300. In some embodiments, apparatus 100 may be connected to device 300 via a connecting means 304, wherein connecting means 304 may be any kind of connecting means, including, but not limited to, cables, such as, but not limited to, a coaxial cable, a universal serial bus (USB) cable, a network cable, an RCA cable, a steel cable, a fiber optic cable, and the like. In embodiments where apparatus 100 is externally connected to device 300, apparatus 100 may draw its power from device 300 via a cable, such as a USB cable, or any other type of power connection, such as a socket, docking bay, and the like. Alternatively, apparatus 100 may include its own means for receiving power from an independent power supply, such as a power socket to be connected to a power cord and plugged into an electrical outlet. In some embodiments, apparatus 100 may be detachably connected to device 300, while in other embodiments apparatus 100 may be undetachably connected to device 300. In addition, display means 302 may be positioned on apparatus 100.

In some embodiments, device 300 may be any device, such as, but not limited to a television box, a television receiver, a cable television box, a satellite television box, an internet modem, a photocopier, a wireless router, a printer, a computer, a vending machine, a scanner, a television, a vehicle, and/or any other device or property that may be the subject of leases.

Figure 4A:
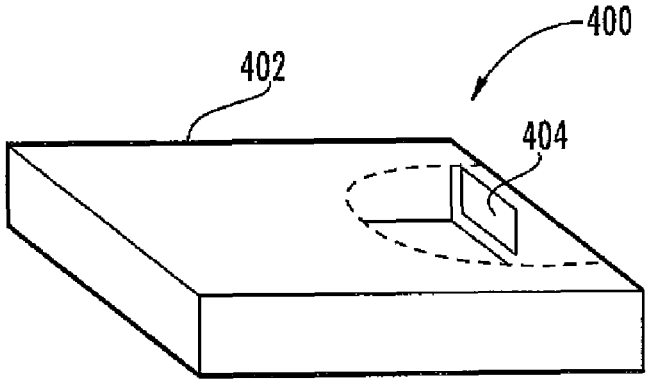
FIGS. 4A, 4B, and 4C show an apparatus in accordance with various other embodiments.
Figure 4B:
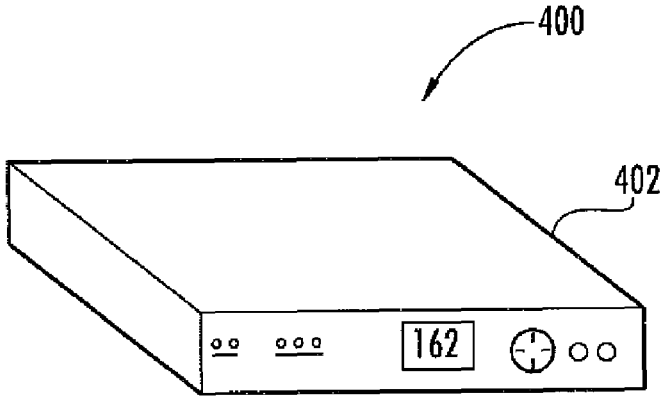
Figure 4C:
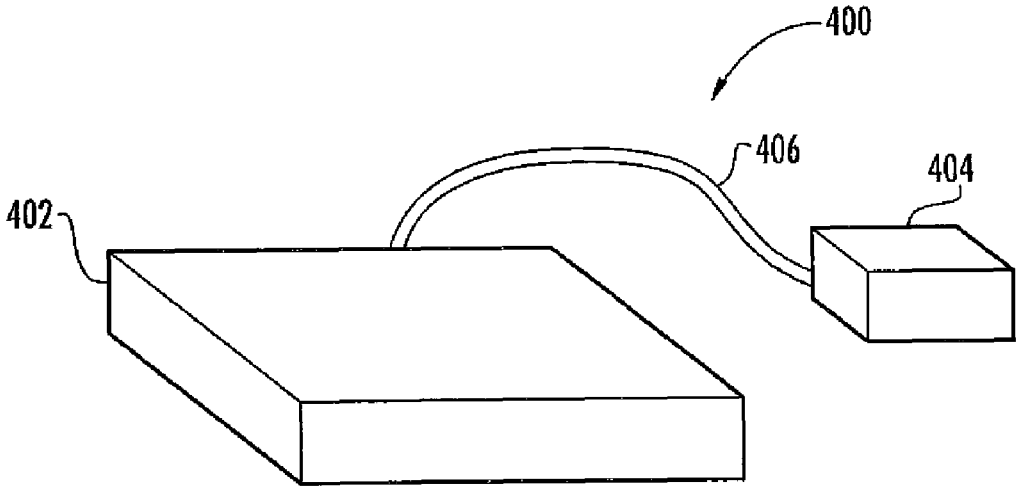

Referring now to FIGS. 4A-4C, various embodiments of apparatus 400 are shown. Apparatus 400 may comprise a case 402, and at least one locator unit 404 connected to the case. In some embodiments, locator unit 404 may be positioned within case 402, as shown in FIG. 4A. In one embodiment, locator unit 404 may be positioned on or near a surface of case 402. In yet another embodiment, locator unit 404 may be positioned outside, or external to case 402, as shown in FIG. 4C. In a further embodiment, locator unit 404 may be externally connected to case 402 by a connecting means 406, wherein connecting means 406 may be a cable, such as, but not limited to, a coaxial cable, a universal serial bus (USB) cable, a network cable, an RCA cable, a steel cable, a fiber optic cable, and the like. In embodiments where locator unit 404 is externally connected to case 402, locator unit 404 may draw its power from a device within case 402 via a cable, such as a USB cable, or any other type of power connection, such as a socket, docking bay, and the like. Alternatively, locator unit 404 may include its own means for receiving power from an independent power supply, such as a power socket to be connected to a power cord and plugged into an electrical outlet. In some embodiments, locator unit 404 may be detachably connected to case 402, while in other embodiments, locator unit 404 may be undetachably connected to case 402.

In a further embodiment, locator unit 404 may comprise a communications means. The communications means may be a wireless communications means, such as, but not limited to, a radio frequency transceiver, a radio frequency receiver, and/or a radio frequency transmitter, including, but not limited to, a Bluetooth module. In embodiments where the wireless communications means is a radio frequency receiver, the radio frequency receiver may be any type of radio frequency receiver, including, but not limited to, a positioning system receiver, such as a global positioning system receiver and a local positioning system receiver, such as a Wi-Fi positioning system receiver. In other embodiments, the communications means may be a wireless modem, such as, but not limited to, a global system for mobile communications (GSM) modern. In some embodiments, locator unit 404 may receive a signal, such as a location determination signal, from a positioning system, such as a global positioning system (GPS, or local positioning system, such as a Wi-Fi positioning system, which may originate from a satellite, or a ground based antenna.

In another embodiment, the communications means may be used to communicate information with a central station, and/or a wireless device, such as any of those wireless devices described throughout the present disclosure. The communications means may be used to solicit a request and/or message, such as a customer service request and/or message from a wireless device, and transmit the request and/or message to a central station. Alternatively, the communications means may be used to receive a response and/or message, such as a customer service response and/or message, from a central station.

In further embodiments, case 402 may be formed of a material selected from the group consisting essentially of a plastic, a wood, a resin, a fiber, and a glass. Alternatively, case 402 may be formed of any suitable material, and/or combination of suitable materials that retain a rigid shape.

In some embodiments, case 402 may be the case for a device, such as, but not limited to, a television box, a television receiver, a cable television box, a satellite television box, an Internet modem, a photocopier, a wireless router, a printer, a computer, a vending machine, a scanner, a television, a vehicle, or any other device or property that may be the subject of leases.

Methods

Figure 5A:
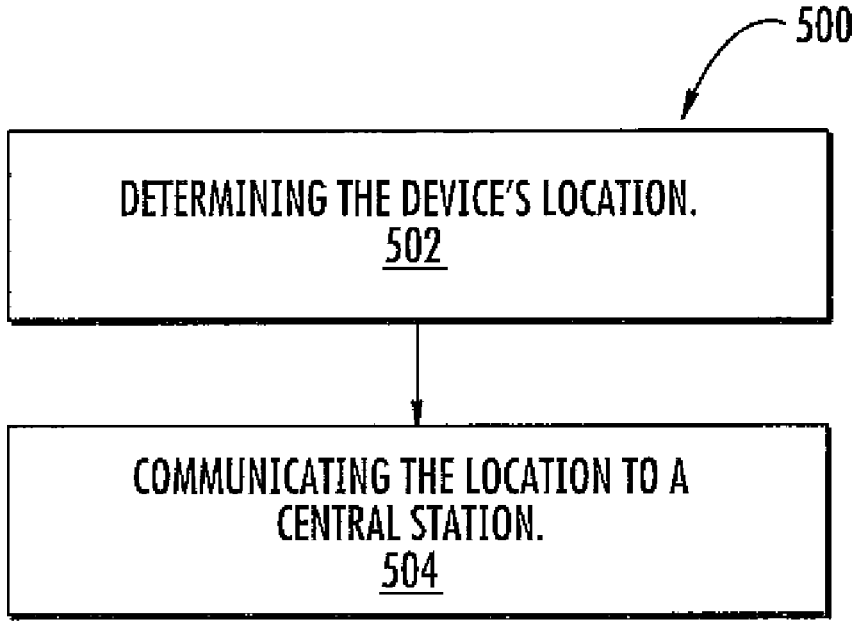
FIGS. 5A and 5B show a flowchart depicting a method in accordance with various embodiments.
Figure 5B:
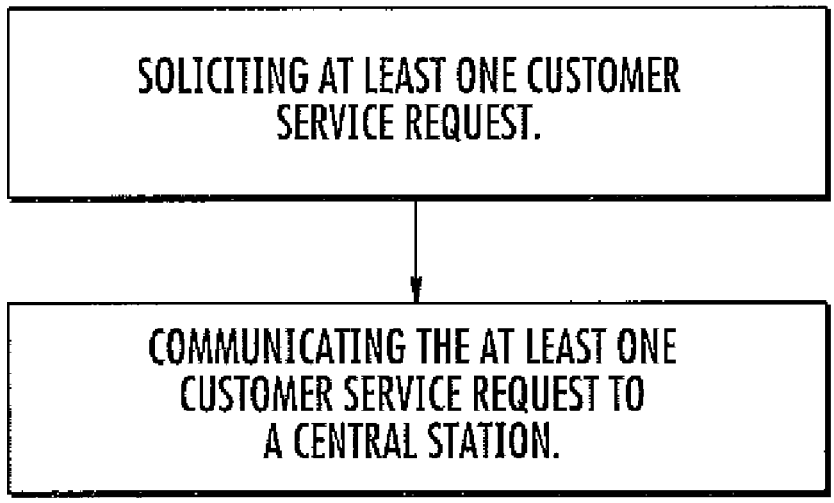

FIGS. 5A and 513 show flow charts depicting various embodiments of method 500, wherein method 500 comprises using at least one processor connected to a device to perform any of the following: determining the device's location (block 502), and communicating the location to a central station (block 504).

In some embodiments, the device may be any type of device, such as but not limited to, a television box, a television receiver, a cable television box, a satellite television box, an internet modem, a photocopier, a wireless router, a printer, a computer, a vending machine, a seamier, a television, a vehicle, or any other device or property that may be the subject of leases.

In one embodiment, determining a device's location 502 may comprise using a locator unit to determine a device's location. In some embodiments, determining a device's location 502 may include calculating the location of the device, such as by triangulating the location of the device based on at least one positioning system signal received by the locator unit described above. The locator, positioning system, and signal may be any of those embodiments described above with reference to FIGS. 1 through 4C and elsewhere throughout the present disclosure.

In yet another embodiment, communicating the location to a central station 504 may include using a communications means to communicate the location to a central station. The communications means and central station may be any of those embodiments described above with reference to FIGS. 1-4C, and elsewhere throughout the present disclosure.

In a further embodiment, determining the device's location 502 comprises the initial step of determining if the device has been disconnected from an external power source.

In yet a further embodiment, method 500 may comprise the additional steps of using at least on processor connected to a device to perform any of the following: soliciting at least one customer service request, and communicating the at least one customer service request to a central station. Additional information may be solicited, such as payments, messages, and other subjects of communication. In some embodiments, the processor may perform the step of receiving a response/message, such as a customer service response/message from a central station. In yet a further embodiment, soliciting a customer service request may include soliciting a customer service request from a wireless device, such as by using a communications means to solicit a customer service request from a wireless device. The communications means and wireless device may be any of those embodiments described above with reference to FIGS. 1 through 4C.

In some embodiments of method 500, the processor may be connected to the device in any of the following ways: mechanically connected, and electronically connected.

In yet a further embodiment, method 500 may comprise the additional step of using at least one processor connected to a device to display at least one image on a display means connected to the device. In some embodiments, the image may be a device's information, such as model number, user information such as lessee, lessor, contract expiration, previous reported and/or recorded locations, previous customer service information, such as, but not limited to, previous customer service issues, resolutions, and unresolved issues, payment information, such as, but not limited to, remaining balance, payment due date, payment amount, and the like, and media, such as, but not limited to, movie trailers and related advertising, general advertising, news, weather, sports news, movies, television shows and advertising therefor, and the like.

Hardware and Operating Environment

This section provides an overview of example hardware and the operating environments in conjunction with which embodiments of the inventive subject matter can be implemented.

A software program may be launched from a computer readable medium in a computer-based system to execute function defined in the software program. Various programming languages may be employed to create software programs designed to implement and perform the methods disclosed herein. The programs may be structured in an object-orientated format using an object-oriented language such as Java or C++. Alternatively the programs may be structured in a procedure-oriented format using a procedural language, such as assembly or C. The software components may communicate using a number of mechanisms, such as application program interfaces, or inter-process communication techniques, including remote procedure calls. The teachings of various embodiments are not limited to any particular programming language or environment. Thus, other embodiments may be realized, as discussed regarding FIG. 6 below.

Figure 6:
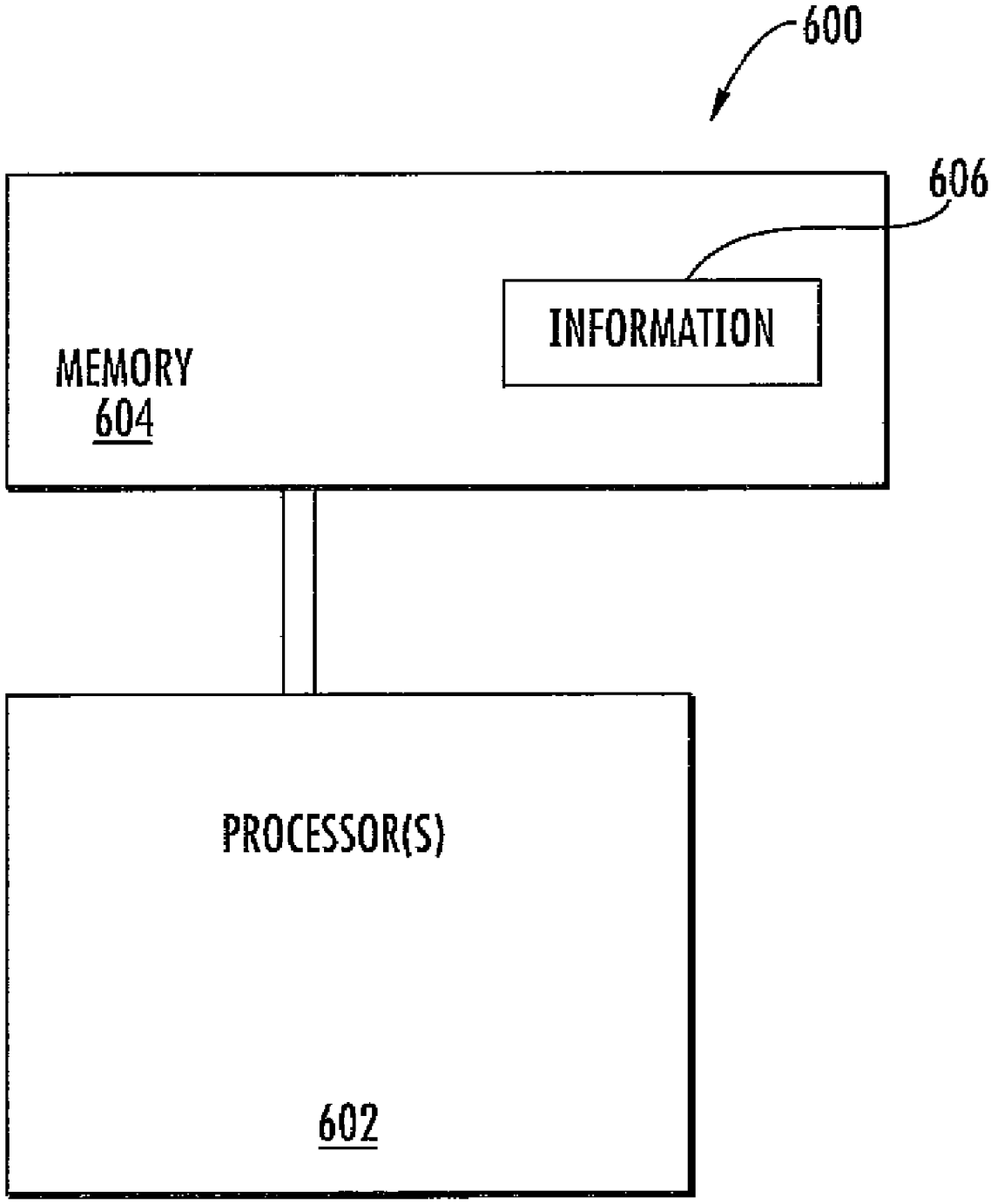
FIG. 6 shows a block diagram depicting an article in accordance with one embodiment.

FIG. 6 is a block diagram representing an article according to various embodiments. Such embodiments may comprise a computer, a memory system, a magnetic or optical disk, some other storage device, or any type of electronic device or system. The article 600 may include one or more processor(s) 602 couple to a machine-accessible medium such as a memory 604 (e.g., a memory including electrical, optical, or electromagnetic elements). The medium may contain associated information 606 (e.g., computer program instructions, data, or both) which, when accessed, results in a machine (e.g., the processor(s) 602) performing the activities previously described herein.

The principles of the present disclosure may be applied to all types of computers, systems, and the like, include desktop computers, servers, notebook computers, personal digital assistants, microcomputers, and the like. However, the present disclosure may not be limited to the personal computer.

While various embodiments have been described herein with reference to human beings, and more specifically soldiers, it is to be understood that the present disclosure may be applied to any sort of object and/or living creature, including humans, in any situation.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. An apparatus comprising:

a. at least one processor configured to be connected to a television box;

b. at least one storage means connected to the at least one processor;

c. at least one locator unit connected to the at least one processor;

d. at least one means for connecting an external power source, wherein the at least one means for connecting an external power source is connected to the at least one processor;

e. at least one internal power source connected to the at least one processor;

f. at least one first communications means connected to the at least one processor; and g. a set of computer executable instructions stored on the at least one storage means and readable by the at least one processor and operative to:

i. determine if the at least one means for connecting an external power source has been disconnected from an external power source, and if the at least one means for connecting an external power source has been disconnected from an external power source, then:

1. activate the at least one internal power source; and 2. use the at least one first communications means to notify a central station that the at least one internal power source has been activated or that an external power source has been disconnected; and ii. use the at least one first communications means to receive an activation signal, and upon receiving the activation signal:

1. activate the at least one locator unit;

2. use the at least one locator unit to determine the apparatus's location; and 3. use the at least one first communications means to transmit the apparatus's location to the central station.

2. The apparatus of claim 1, wherein the at least one locator unit is any one of the following: a global positioning system module and a wireless network positioning system module.

3. The apparatus of claim 1, wherein the at least one processor is configured to be externally connected to the television box, or internally mounted in the television box.

4. The apparatus of claim 1, further comprising at least one case that is operative to entirely or partially encase any or all of the following: the at least one processor, the at least one storage means, the at least one locator unit, the at least one internal power source, the at least one means for connecting an external power source, and the at least one first communications means.

5. The apparatus of claim 4, wherein the at least one case is operative to be externally connected to the television box, or internally mounted in the television box.

6. The apparatus of claim 5, wherein the at least one case is operative to be externally connected to the television box via a cable.

7. The apparatus of claim 4, wherein the at least one case comprises at least one external display means that is connected to the at least one processor.

8. The apparatus of claim 7, wherein the computer executable instructions are operative to use the at least one display means to display customer service information, advertisements, media content, television box information, or locator unit information.

9. The apparatus of claim 1 further comprising an activation switch for activating the at least one locator unit, wherein the activation switch is connected to the at least one locator unit, and wherein the activation switch is operative to activate the at least one locator unit upon receiving an activation radio signal, or upon an external power source being disconnected from the at least one means for connecting an external power source.

10. The apparatus of claim 1, further comprising a radio frequency identification tag.

11. The apparatus of claim 1, wherein the at least one means for connecting an external power source comprises at least one means for connecting a television box power source.

12. The apparatus of claim 1, wherein the computer executable instructions are operative to use at least one second communications means to communicate locally with at least one wireless device.

13. The apparatus of claim 12, wherein the computer executable instructions are operative to use the at least one second communications means to receive at least one customer service request from the at least one wireless device.

14. The apparatus of claim 13, wherein the computer executable instructions are operative to use the at least one first communications means to transmit the at least one customer service request to the central station.

15. The apparatus of claim 1, further comprising at least one display means connected to the at least one processor.

16. The apparatus of claim 15, wherein the computer executable instructions are operative to use the at least one display means to display customer service information, advertisements, media content, television box information, or locator unit information.

17. An apparatus comprising:

a. a television box comprising at least one processor;

b. a first communications means connected to the at least one processor;

c. at least one locator unit connected to the at least one processor;

d. at least one means for connecting an external power source, wherein the at least one means for connecting an external power source is connected to the at least one processor;

e. at least one internal power source connected to the at least one processor;

f. at least one storage means connected to the at least one processor; and g. computer executable instructions stored on the at least one storage means and readable by the at least one processor and operative to:

i. determine if the at least one means for connecting an external power source has been disconnected from an external power source, and if the at least one means for connecting an external power source has been disconnected from an external power source, then:

1. activate the at least one internal power source; and 2. use the at least one first communications means to notify a central station that the at least one internal power source has been activated or that an external power source has been disconnected; and ii. use the at least one first communications means to receive an activation signal, and upon receiving the activation signal:

1. activate the at least one locator unit;

2. use the at least one locator unit to determine the apparatus's location; and 3. use the at least one first communications means to transmit the apparatus's location to the central station.

18. The apparatus of claim 17, wherein the at least one locator unit is positioned in a location selected from the group consisting essential of: within the television box, on the surface of the television box, and external to the television box.

19. The apparatus of claim 17 wherein the at least one locator unit comprises at least one second communications means connected to the at least one processor, wherein the at least one second communications means is operative to locally receive at least one customer service request from at least one wireless device.

20. The apparatus of claim 17 further comprising at least one display means connected to the at least one processor.

21. The apparatus of claim 19, wherein the computer executable instructions are operative to use the at least one first communications means to transmit the at least one customer service request to the central station.

22. A method comprising:

a. using at least one processor configured to be connected to a television box to perform any or all of the following:

i. determining if at least one means for connecting an external power source has been disconnected from an external power source, wherein the at least one means for connecting an external power source is connected to the at least one processor, and if the at least one means for connecting an external power source has been disconnected from an external power source, then:

1. activating at least one internal power source, wherein the at least one internal power source is connected to the at least one processor; and 2. using at least one first communications means connected to the at least one processor to notify a central station that the at least one internal power source has been activated or that an external power source has been disconnected; and ii. using the at least one first communications means to receive an activation signal, and upon receiving the activation signal:

3. activating at least one locator unit;

4. using the at least one locator unit to determine the at least one processor's or the television box's location; and 5. use the at least one first communications means to transmit the location of the at least one processor or the television box to the central station.

23. The method of claim 22, wherein the at least one locator unit comprises any one of the following: a global positioning system module and a wireless network positioning system module.

24. The method of claim 22, wherein wherein the at least one processor is configured to be externally connected to the television box, or internally mounted in the television box.

25. The method of claim 22, wherein at least one of the at least one processor, the at least one storage means, the at least one locator unit, the at least one internal power source, the at least one means for connecting an external power source, and the at least one first communications means is encased, entirely or partially by at least one case.

26. The method of claim 25, wherein the at least one case is operative to be externally connected to the television box, or internally mounted in the television box.

27. The method of claim 22, further comprising using the at least one processor to perform any or all of the following:

a. using at least one second communications means to locally receive at least one customer service request from at least one wireless device; and b. communicating the at least one customer service request to the central station.

28. The method of claim 27, further comprising using the at least one processor connected to the television box to receive at least one response to a customer service request from the central station.

29. The method of claim 22, wherein the at least one processor is configured to be connected to the television box in a manner selected from the group consisting essentially of: mechanically connected, electronically connected, and wirelessly connected.

30. The method of claim 22, further comprising using at least one display means connected to the at least one processor to display customer service information, advertisements, media content, television box information, or locator unit information.

* * * * *